US009940847B1

(12) United States Patent
Zavoyskikh

(10) Patent No.: US 9,940,847 B1
(45) Date of Patent: Apr. 10, 2018

(54) VIRTUAL REALITY EXERCISE DEVICE

(71) Applicant: Anton Zavoyskikh, Los Angeles, CA (US)

(72) Inventor: Anton Zavoyskikh, Los Angeles, CA (US)

( * ) Notice: Subject to any disclaimer, the term of this patent is extended or adjusted under 35 U.S.C. 154(b) by 69 days.

(21) Appl. No.: 15/283,391

(22) Filed: Oct. 1, 2016

(51) Int. Cl.
*A63B 24/00* (2006.01)
*G09B 9/00* (2006.01)
*G09B 5/02* (2006.01)

(52) U.S. Cl.
CPC ..... *G09B 9/00* (2013.01); *A63B 24/0062* (2013.01); *A63B 24/0087* (2013.01); *G09B 5/02* (2013.01)

(58) Field of Classification Search
CPC . A63B 24/00; A63B 24/0087; A63B 24/0062; G09B 9/00; G09B 5/02
See application file for complete search history.

(56) References Cited

U.S. PATENT DOCUMENTS 5,792,031 A * 8/1998 Alton ..... A63B 69/0059 482/78
6,088,017 A * 7/2000 Tremblay ..... G06F 3/011 345/156
7,780,573 B1 * 8/2010 Carmein ..... A63B 22/0242 482/4
2006/0132433 A1 * 6/2006 Kramer ..... G06F 3/016 345/156
2011/0306473 A1 * 12/2011 Saglia ..... A61H 1/0266 482/79

* cited by examiner

*Primary Examiner* — Glenn Richman

(57) ABSTRACT

A virtual reality exercise device including : at least one actuator; at least one of a handle, a foot stirrup, a step, and a limb strap, where the at least one actuator is coupled to the at least one of a handle, a foot stirrup, a step, and a limb strap, where the actuator is designed to provide resistance force to at least one motion carried out by the user; a computer processor; computer readable non-transitory medium coupled in communication with the computer processor; an actuator control circuit coupled in communication to the computer processor and adapted to receive signals from the computer processor and output the signals to control the at least one actuator; a software algorithm stored on the computer readable non-transitory medium, where the computer processor executes the software algorithm, where the computer processor outputs a signal that is at least partially used by the actuator control circuit to control the at least one actuator; a virtual reality display coupled in communication to the processor, wherein the virtual reality display is adapted to create a visual display for the user, wherein the communication between the processor and the virtual reality display is adapted to synchronize the force output of the at least one actuator and the virtual reality display. The virtual reality exercise device is preferably designed to provide variable, interactive, and immersive exercises that include force the follows along with either real world physical activities, or fantasy activities, while at the same time providing physical exercise for the user. There may, however, be any suitable use for the virtual reality exercise device.

20 Claims, 2 Drawing Sheets

VIRTUAL REALITY EXERCISE DEVICE

DESCRIPTION OF THE PREFERRED EMBODIMENTS

The description that follows of the invention's preferred embodiments is meant to enable someone skilled in the prior art to make and use the invention, but is not meant to limit the invention to these preferred embodiments.

1. First Preferred Embodiment

Figure 1:
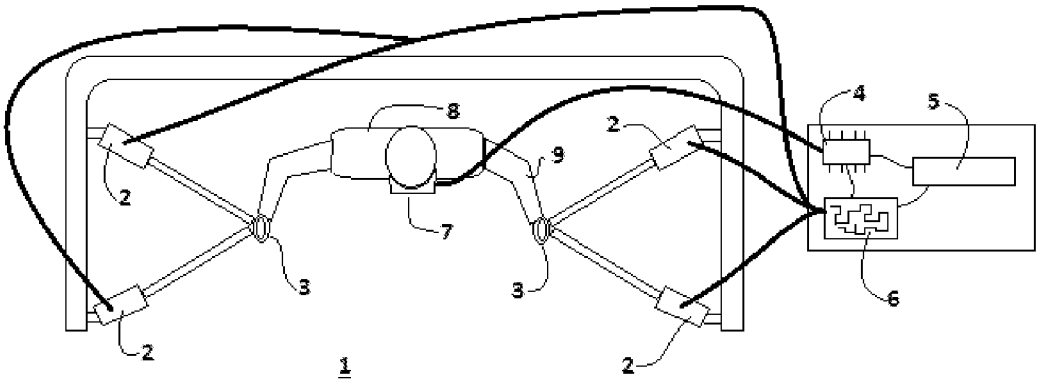
FIG. 1 is a schematic representation of the system of the first preferred embodiments, viewed from the top.

As shown in FIG. 1, the system of the preferred embodiments is a virtual reality exercise device 1 including : at least one actuator 2; at least one of a handle 3, a foot stirrup 3, a step 3, and a limb 9 strap 3, where the at least one actuator 2 is coupled to the at least one of a handle 3, a foot stirrup 3, a step 3, and a limb 9 strap 3, where the actuator 2 is designed to provide resistance force to at least one motion carried out by the user 8; a computer processor 4; computer readable non-transitory medium 5 coupled in communication with the computer processor 4; an actuator 2 control circuit 6 coupled in communication to the computer processor 4 and adapted to receive signals from the computer processor 4 and output the signals to control the at least one actuator 2; a software algorithm stored on the computer readable non-transitory medium 5, where the computer processor 4 executes the software algorithm, where the computer processor 4 outputs a signal that is at least partially used by the actuator 2 control circuit 6 to control the at least one actuator 2; a virtual reality display 7 coupled in communication to the processor 4, wherein the virtual reality display 7 is adapted to create a visual display for the user 8, wherein the communication between the processor 4 and the virtual reality display 7 is adapted to synchronize the force output of the at least one actuator 2 and the virtual reality display 7. The virtual reality exercise device 1 is preferably designed to provide variable, interactive, and immersive exercises that include force the follows along with either real world physical activities, or fantasy activities, while at the same time providing physical exercise for the user 8. There may, however, be any suitable use for the virtual reality exercise device 1.

Figure 3:
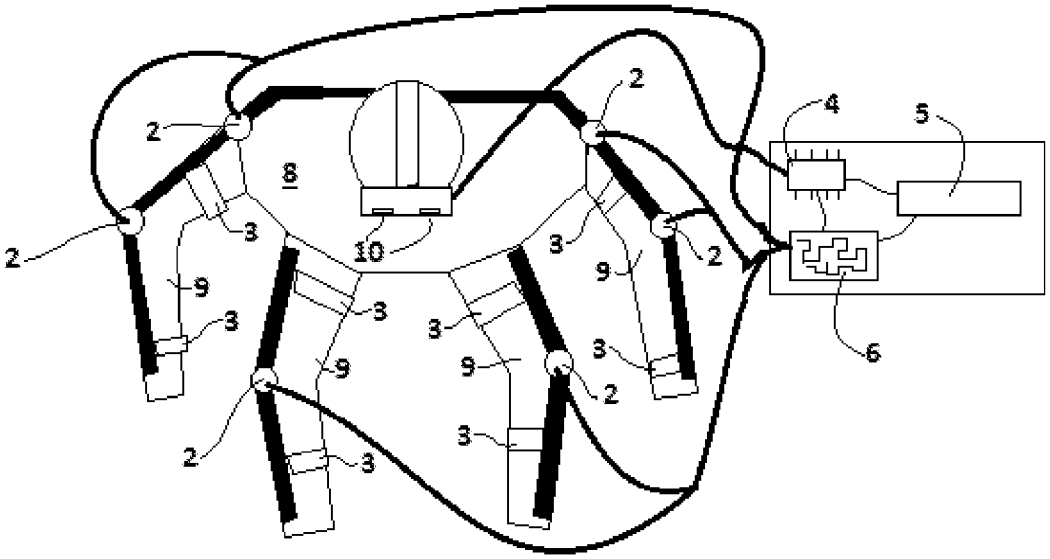
FIG. 3 is a schematic representation of the system of the first preferred embodiments viewed from a 3/4 top angle, where the virtual reality exercise device includes rigid members strapped to a user's limbs.

As shown in FIG. 3, in a preferred variation of the system of the preferred embodiments, the virtual reality display 7 is a stereoscopic video display. In another variation, the virtual reality display 7 is a monoscopic video display. As shown in FIG. 3, in a preferred variation of the system of the preferred embodiments, the virtual reality display 7 is a stereoscopic headset, including at least one display per eye. In a variation of this variation, each display is at least one of a screen 10 and a projector 10. In a variation of this variation, the displays are retinal projector 10 displays. In the variation using a stereoscopic display, the user 8 is provided with a more immersive three dimensional display. In a variation of this variation, a sensor detects the movement of the user's head and moves the virtual display shown to the user 8 corresponding to the user's head movements. In a preferred embodiment, the system of the preferred embodiments may further include a speaker, where the speaker is designed to provide audio output that correlates to both the visual display and the force output from the at least one actuator 2. There may, however, be any suitable virtual reality display 7 that provides the user 8 with visual input corresponding to the force provided against the user 8.

Figure 2:
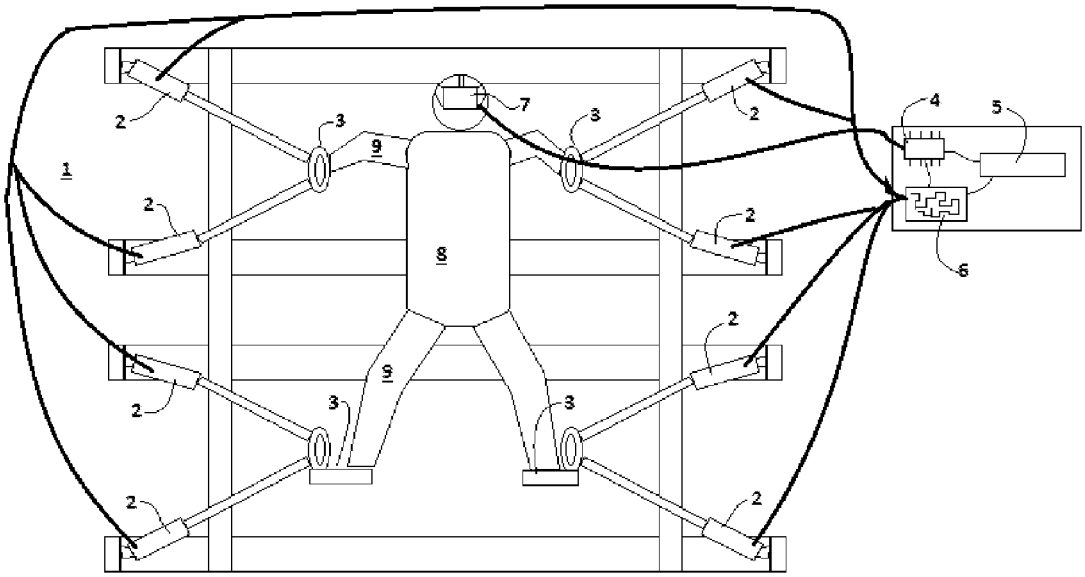
FIG. 2 is a schematic representation of the system of the first preferred embodiments viewed from the front.

As shown in FIG. 1, there is at least one actuator 2 coupled to at least one of a handle 3, a foot stirrup 3, a step 3, and a limb 9 strap 3. The actuator 2 is coupled in communication, preferably by at least one of an electrical connection, a wireless communication connection, and a fiber optic connection, to an actuator 2 control circuit 6. The actuator 2 control circuit 6 is preferably coupled in communication to a computer processor 4, and the computer processor 4 is preferably coupled to computer readable non-transitory storage medium. Preferably a software algorithm is stored on the computer readable non-transitory storage medium, and the software algorithm is executed by the computer processor 4. In an alternate embodiment, a remote software algorithm can transmit data to the processor 4, which can execute a native software algorithm to factor in the received data from the remote software algorithm. Preferably the processor 4 coordinates signals to the actuator 2 control circuit 6 so that the visual output to the virtual reality display 7 is coordinated with the movement of the actuator 2. In a preferred embodiment, there are at least four actuators 2, at least one for each of the user's limbs 9. Preferably in this embodiment the at least four actuators 2 are coupled to at least four of at least one of a handle 3, a foot stirrup 3, a step 3, and a limb 9 strap 3. As shown in FIG. 2, a variation of this variation may include at least three actuators 2 per limb, with at least two actuators 2 separated front to back to provide variation in forward-backward forces, and at least one additional actuator 2 separated vertically from the at least two actuators 2. This variation preferably provides three degrees of freedom of force application on each of the user's limb, to provide at least one of force resistance and force feedback in three degrees of freedom per limb. In a preferred embodiment, as shown in FIGS. 1 and 2, each actuator 2 is attached to the appropriate at least one of a handle 3, a foot stirrup 3, a step 3, and a limb 9 strap 3 by a rigid rod. In a variation of this variation, the actuators 2 are linear actuators 2, at least one of pneumatic, hydraulic, and electromechanical linear actuators 2. As shown in FIG. 3, in an alternate embodiment, articulated arms including at least two rigid members, at least two pivoting joints, at least two limb 9 strap 3s, and at least two actuators 2 are attached to the user's limbs 9, with at least one articulated arm on each of the user's limbs 9. In this preferred embodiment, the articulated arms are adapted to provide at least one of resistance force and feedback force to at least two of the user's joints on each limb. In a variation of this variation, the articulated arms attached to the user's arms provide at least one of resistance force and feedback force to the movement of the user's arm relative to the elbow joint and shoulder joint, and the articulated arms attached to the user's legs provide at least one of resistance force and feedback force to the movement of the user's leg relative to the knee joint and hip joint. There may, however, be any suitable layout for providing at least one of resistance force and feedback force to at least one of a user's limbs 9.

In a preferred variation of the system of the preferred embodiments, the virtual reality display 7 shows the user 8 at least one of a simulation and video, where the at least one of a simulation and video shows a first person perspective from at least one of an athletic activity, a workout activity, and a physical activity. In this variation, the processor 4 signals the actuator 2 control circuit 6 to command the at least one actuator 2 to create forces that correspond to the forces that would go along with the at least one of an athletic activity, a workout activity, and a physical activity. In one example of this variation, the user 8 may be shown a first person perspective video of rock climbing, and the processor 4 may signal the actuator 2 control circuit 6 to control the at least one actuator 2 to provide resistance force corresponding to the rock climbing video the user 8 sees in the virtual reality display 7. In another example of this variation, the user 8 may be shown first person perspective video of a boxing match and the actuators 2 may be controlled to provide force corresponding to the boxing match visual. In another variation of this variation, almost any of at least one of a sport, a workout activity, and a physical activity may be displayed by the virtual reality display 7. In an alternate embodiment, the at least one of a simulation and video may be shown from a third person perspective. In an alternate embodiment, the at least one of a simulation and video may depict at least one of a fantasy situation and a video game situation.

As a person skilled in the art will recognize from the previous detailed description and from the figures and claims, modifications and changes can be made to the preferred embodiments of the invention without departing from the scope of this invention defined in the following claims.

I claim:

1. An virtual reality exercise device comprising: at least one actuator; at least one of a handle, a foot stirrup, a step, and a limb strap, wherein the at least one actuator is coupled to the at least one of a handle, a foot stirrup, a step, and a limb strap, wherein the actuator is adapted to provide resistance force to at least one motion carried out by the user; a computer processor; computer readable non-transitory storage medium coupled in communication with the computer processor; an actuator control circuit coupled in communication to the computer processor and adapted to receive signals from the computer processor and output the signals to control the at least one actuator; a software algorithm stored on the computer readable non-transitory storage medium, wherein the computer processor executes the software algorithm, wherein the computer processor outputs a signal that is at least partially used by the actuator control circuit to control the at least one actuator; a virtual reality display coupled in communication to the processor, wherein the virtual reality display is adapted to create a visual display for the user, wherein the communication between the processor and the virtual reality display is adapted to synchronize the force output of the at least one actuator and the virtual reality display.

2. The virtual reality exercise device of claim 1, wherein the virtual reality display is a stereoscopic video display.

3. The virtual reality exercise device of claim 2, wherein the virtual reality display is a stereoscopic headset with at least one of a projector and a screen for each of the user's two eyes.

4. The virtual reality exercise device of claim 1, wherein for each of the user's limbs there is at least one of the at least one actuator is coupled to the at least one of a handle, a foot stirrup, a step, and a limb strap.

5. The virtual reality exercise device of claim 2, wherein for each of the user's limbs there is at least one of the at least one actuator is coupled to the at least one of a handle, a foot stirrup, a step, and a limb strap.

6. The virtual reality exercise device of claim 3, wherein for each of the user's limbs there is at least one of the at least one actuator is coupled to the at least one of a handle, a foot stirrup, a step, and a limb strap.

7. The virtual reality exercise device of claim 4, comprising at least four actuators, wherein for each of the user's limbs at least one actuator is attached to at least one of the at least one of a handle, a foot stirrup, a step, and a limb strap.

8. The virtual reality exercise device of claim 5, comprising at least four actuators, wherein for each of the user's limbs at least one actuator is attached to at least one of the at least one of a handle, a foot stirrup, a step, and a limb strap.

9. The virtual reality exercise device of claim 6, comprising at least four actuators, wherein for each of the user's limbs at least one actuator is attached to at least one of the at least one of a handle, a foot stirrup, a step, and a limb strap.

10. The virtual reality exercise device of claim 1, wherein the virtual reality display is adapted to display at least one of a simulation and video, wherein the at least one of a simulation and video shows a first person perspective from at least one of an athletic activity, a workout activity, and a physical activity, wherein the processor signals the actuator control circuit to command the at least one actuator to create forces that correspond to the forces that would go along with the at least one of an athletic activity, a workout activity, and a physical activity.

11. The virtual reality exercise device of claim 2, wherein the virtual reality display is adapted to display at least one of a simulation and video, wherein the at least one of a simulation and video shows a first person perspective from at least one of an athletic activity, a workout activity, and a physical activity, wherein the processor signals the actuator control circuit to command the at least one actuator to create forces that correspond to the forces that would go along with the at least one of an athletic activity, a workout activity, and a physical activity.

12. The virtual reality exercise device of claim 3, wherein the virtual reality display is adapted to display at least one of a simulation and video, wherein the at least one of a simulation and video shows a first person perspective from at least one of an athletic activity, a workout activity, and a physical activity, wherein the processor signals the actuator control circuit to command the at least one actuator to create forces that correspond to the forces that would go along with the at least one of an athletic activity, a workout activity, and a physical activity.

13. The virtual reality exercise device of claim 4, wherein the virtual reality display is adapted to display at least one of a simulation and video, wherein the at least one of a simulation and video shows a first person perspective from at least one of an athletic activity, a workout activity, and a physical activity, wherein the processor signals the actuator control circuit to command the at least one actuator to create forces that correspond to the forces that would go along with the at least one of an athletic activity, a workout activity, and a physical activity.

14. The virtual reality exercise device of claim 5, wherein the virtual reality display is adapted to display at least one of a simulation and video, wherein the at least one of a simulation and video shows a first person perspective from at least one of an athletic activity, a workout activity, and a physical activity, wherein the processor signals the actuator control circuit to command the at least one actuator to create forces that correspond to the forces that would go along with the at least one of an athletic activity, a workout activity, and a physical activity.

15. The virtual reality exercise device of claim 6, wherein the virtual reality display is adapted to display at least one of a simulation and video, wherein the at least one of a simulation and video shows a first person perspective from at least one of an athletic activity, a workout activity, and a physical activity, wherein the processor signals the actuator control circuit to command the at least one actuator to create forces that correspond to the forces that would go along with the at least one of an athletic activity, a workout activity, and a physical activity.

16. The virtual reality exercise device of claim 8, wherein the virtual reality display is adapted to display at least one of a simulation and video, wherein the at least one of a simulation and video shows a first person perspective from at least one of an athletic activity, a workout activity, and a physical activity, wherein the processor signals the actuator control circuit to command the at least one actuator to create forces that correspond to the forces that would go along with the at least one of an athletic activity, a workout activity, and a physical activity.

17. The virtual reality exercise device of claim 9, wherein the virtual reality display is adapted to display at least one of a simulation and video, wherein the at least one of a simulation and video shows a first person perspective from at least one of an athletic activity, a workout activity, and a physical activity, wherein the processor signals the actuator control circuit to command the at least one actuator to create forces that correspond to the forces that would go along with the at least one of an athletic activity, a workout activity, and a physical activity.

18. The virtual reality exercise device of claim 9, wherein the virtual reality display is adapted to display at least one of a simulation and video, wherein the at least one of a simulation and video shows a first person perspective from at least one of an athletic activity, a workout activity, and a physical activity, wherein the processor signals the actuator control circuit to command the at least one actuator to create forces that correspond to the forces that would go along with the at least one of an athletic activity, a workout activity, and a physical activity.

19. The virtual reality exercise device of claim 18, wherein the at least four actuators are adapted to provide force in at least three degrees of freedom to at least each of a user's limbs, and each of a user's hands and feet.

20. The virtual reality exercise device of claim 19, wherein an articulated arm with at least two rigid members and at least two joints is strapped by at least two straps to each of a user's limbs to follow the movement of at least the user's upper and lower limb; at least two actuators attached to each articulated arm, wherein the at least two actuators are adapted to provide force that interacts with the motion of at least two of the user's joints on each limb.

* * * * *